US006135381A

United States Patent [19]

Teson

[11] Patent Number: 6,135,381

[45] Date of Patent: Oct. 24, 2000

[54] CORD HOLDER

[76] Inventor: William R. Teson, 7406 NE. 148th Ave., Vancouver, Wash. 98682

[21] Appl. No.: 09/281,578

[22] Filed: Mar. 30, 1999

[51] Int. Cl.[7] ..... B65H 75/06; B65H 75/40

[52] U.S. Cl. ..... 242/404.3; 242/405.2

[58] Field of Search ..... 242/405, 405.1, 242/405.2, 404.3, 400.1, 129, 222, 613.3; 191/12 R, 12.2 R; D8/358, 360.1; D13/139.7

[56] References Cited

U.S. PATENT DOCUMENTS

| | | | |
|---|---|---|---|
| D. 330,323 | 10/1992 | Hu | D8/358 |
| 1,784,064 | 12/1930 | Griswold | 242/405 |
| 2,204,939 | 6/1940 | Lyons | 191/12 R |
| 2,490,279 | 12/1949 | Nunamaker | 242/405.1 |
| 4,688,739 | 8/1987 | Moore . | |
| 4,778,125 | 10/1988 | Hu | 242/405.2 |
| 4,997,997 | 3/1991 | Moore | 191/12.2 |
| 5,429,321 | 7/1995 | Skyba | 242/591 |
| 5,957,401 | 9/1999 | O'Donnell | 242/405.1 |
| 6,003,803 | 12/1999 | Knapp et al. | 242/405.2 |

*Primary Examiner*—John M. Jillions
*Attorney, Agent, or Firm*—James D. Givnan, Jr.

[57] ABSTRACT

A holder for a length of cord or rope is of unitary construction having a main body from which projects a hand grip which terminates in a hook-shaped support for the several runs of cord or rope supported thereon. The close proximity of the hand grip to the cord runs permits retention of the runs against slipping by contact with a user's finger. The main body additionally defines an opening through which the cord or rope end segment is entrained with the segment additionally being received within grooves in the main body defining a retainer around which the cord segment is routed to effect holder attachment to the segment. An arm on the main body serves to permit temporary placement of the present holder on a support surface to permit convenient positioning of the holder and cord thereon at a work site.

3 Claims, 1 Drawing Sheet

CORD HOLDER

BACKGROUND OF THE INVENTION

The present invention pertains generally to devices for holding a cord or rope of several feet in length in an orderly fashion.

In the prior art are several types of holders for the storage of a drop cord or rope. A problem not always addressed by such devices is the deploying the cord or rope for use in a manner avoiding tangling of same. Still further, the prior holders do not envision rapid entrainment of a cord on the holder or a holder attachable to the person permitting free use of both of the user's hands on other tasks.

U.S. Pat. No. 4,688,739 discloses a cord holder having a handle and defining a slot in which cord segments are received. A spring biased latch prevents inadvertent separation of the coiled cord.

U.S. Pat. No. 4,997,997 discloses a hose holder similar to the foregoing patent wherein coils of hose or cord are slidably received within a slot shaped opening of the holder.

U.S. Pat. No. 5,429,321 discloses a storage device for cord or hose or rope defining an elongate receiving area which is partially defined by a positionable member to hold the stored material in a releasable manner with segments thereof supported in a stacked manner. A modification of the device includes a one piece cord holder with an elongate opening for cord reception and having a member for engagement with the user's belt.

SUMMARY OF THE PRESENT INVENTION

The present invention is embodied within a holder on which a cord or rope may be placed in rapid fashion with the formation of loops to both sides of the device which, when removed and placed on the floor or other surface, avoids the risk of tangling.

A hand grip of the device is located adjacent to and partially defines an area in which the stored cord is supported with the user's fingers also located in the area enabling cord against slipping. Accordingly, loops of the cord each several feet in length, are formed by entraining the cord first in one direction and then in an opposite direction over a supporting surface of the device. It has been found that collecting the stored rope in such a manner permits runs of the cord to be grasped and removed and dropped on the ground without tangling.

An arm of the device serves to support the device on the user's attire, for example, by insertion through a belt loop, as well as permit placement on a flat, horizontal surface for positioning of the device in a highly accessible location.

A retainer portion of the holder permits securing of a cord end segment to the holder to keep the cord or rope and the holder together during use of the cord. Such attachment of the holder to the cord avoids risk of loss of the holder.

Important objectives include the provision of a cord or rope holder of unitary construction configured to receive a sizeable quantity of cord or rope which, when removed and placed on the ground, will pay out without tangling; the provision of a cord holder shaped to permit one or more of the user's fingers to retain the cord against slippage during installation on the holder enabling the formation of uniform loops on both sides of the holder; the provision of a rope holder having an arm component shaped to permit supporting the holder on a flat, horizontal surface when supporting several feet of cord.

DETAILED DESCRIPTION OF THE PREFERRED EMBODIMENTS

Figure 1:
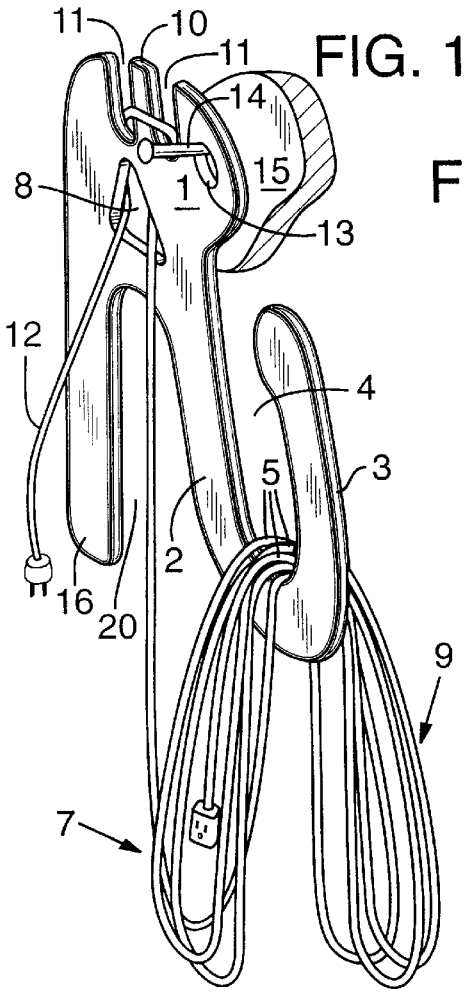
FIG. 1 is a perspective view of the present holder supported in place on a wall fragment with a length of cord or rope stored thereon.

With continuing attention to the drawings, the reference numeral 1 indicates the main body of the holder embodying the present invention.

Figure 2:
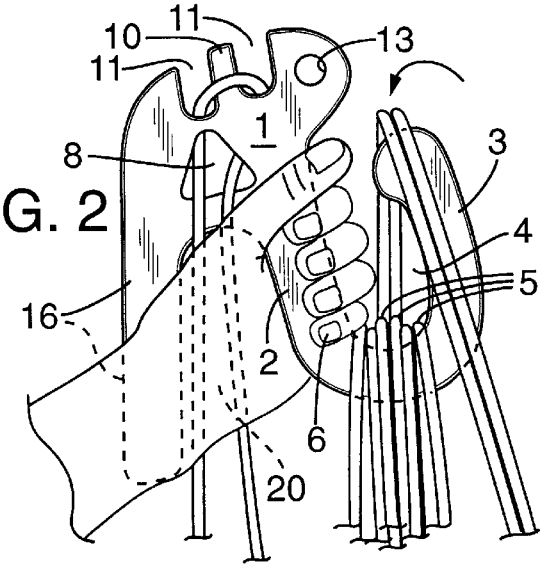
FIG. 2 is a front elevational view of the holder held in place by a user's hand during the looping of a cord thereon.

Hand grip 2 of the holder is elongate and of a length to accommodate the fingers of one hand as shown in FIG. 2. The hand grip is integral with a hook shaped support 3 and defines herewith an open area 4 in which several runs of a cord 5 are received in random fashion. When storing a cord of considerable length it has been found advisable to form the cord into loops generally at 7 and 9 each approximately three or four feet in length. During such looping of the cord back and forth over hook shaped support 3 of the holder, a user's finger 6 may be extended to bear upon a run or runs 5 of the cord in the holder to hold same against slipping.

To deploy the rope, etc., the user grasps the several runs 5 in area 4 and lifts them out of area 4 and lay loops 7 and 9 on a floor or ground surface. A cord or rope end is pulled away from the loops with little or no tendency of the rope to tangle.

An opening 8 in the holder and a retainer 10, defined by slots 11 in main body 1, provide adequate frictional engagement to maintain an entrained cord end segment 12 in place on the holder to prevent accidental dislodgment or separation from the holder during cord use. While opening 8 is shown as preferably being triangular it may be of other configuration. An additional opening at 13 in the holder permits suspension of the holder on a support 14 imbedded in a wall 15.

Figure 3:
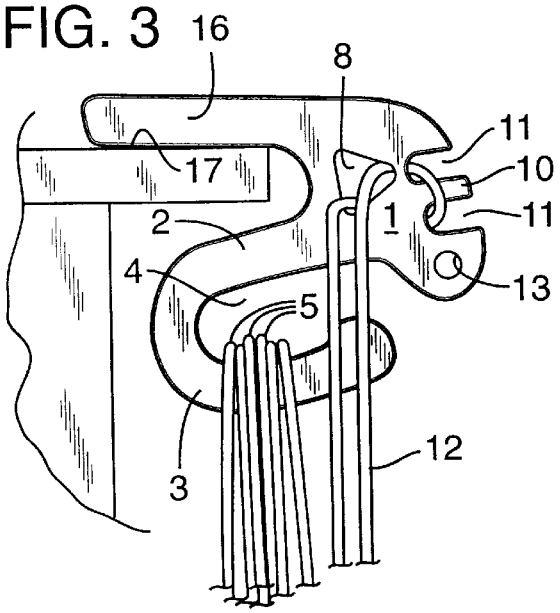
FIG. 3 is an elevational view of the present holder with a length of cord thereon and supported in place by a flat, horizontal surface.
Figure 4:
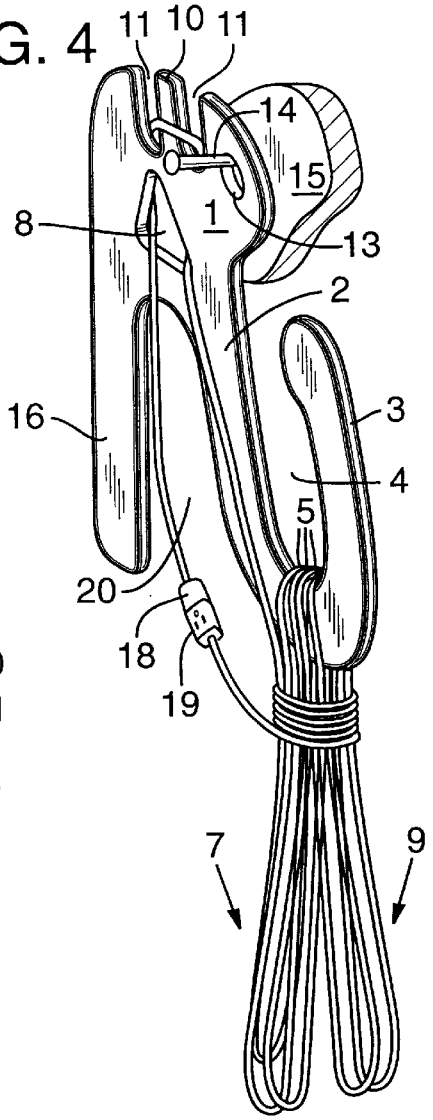
FIG. 4 is a perspective view of the holder with a length of rope stored thereon.

An arm 16 of the holder is of elongate shape and permits insertable engagement with the user's attire, e.g., insertion through a belt loop or into a pocket, to allow the user to utilize his or her hands in another task. Arm 16 preferably diverges outwardly and away from hand grip 2 and permits suspension of the holder and a cord thereon by arm contact, as shown in FIG. 3, with a flat, horizontal surface at 17 located near a work site. A plug and socket of an electrical drop cord are shown at 18 and 19 and may be utilized to hold a drop cord securely in place on the holder as shown in FIG. 4. Arm 16 and hand grip 2 define a palm receiving open ended area 20.

While I have shown but one embodiment of the invention, it will be apparent to those skilled in the art that the invention may be embodied still otherwise without departing from the spirit and scope of the invention.

Having thus described the invention, what is desired to be secured by a Letters Patent is:

I claim:

1. A holder for storage of a cord or rope several feet in length and comprising, a main body, a hand grip projecting from the main body, a hook shaped support integral with and extending from said hand grip and defining therewith an area to receive several runs of a cord or rope, and said main body including a retainer defined by oppositely disposed slots, said main body defining an opening through which a cord or rope may be entrained for passage about said retainer for attachment of the holder to the cord or rope.

2. The holder claimed in claim 1 additionally including an arm integral with the main body and offset from said hand grip for insertion into a support for the holder.

3. The holder claimed in claim 2 wherein said arm and said hand grip are in divergent relationship in a direction away from the main body.

* * * * *